US008794744B2

(12) United States Patent
Yan et al.

(10) Patent No.: US 8,794,744 B2
(45) Date of Patent: Aug. 5, 2014

(54) INKJET UNIT AND INKJET DEVICE

(75) Inventors: Mao-cheng Yan, Shenzhen (CN); Hsiang-yin Shih, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 13/379,351

(22) PCT Filed: Oct. 17, 2011

(86) PCT No.: PCT/CN2011/080868
§ 371 (c)(1),
(2), (4) Date: Dec. 19, 2011

(87) PCT Pub. No.: WO2013/037151
PCT Pub. Date: Mar. 21, 2013

(65) Prior Publication Data

US 2013/0063526 A1 Mar. 14, 2013

(30) Foreign Application Priority Data

Sep. 14, 2011 (CN) ..... 2011203443018

(51) Int. Cl.
*B41J 2/14* (2006.01)

(52) U.S. Cl.
USPC ..... 347/47

(58) Field of Classification Search
CPC ..... B41J 2/04526
USPC ..... 347/47
See application file for complete search history.

(56) References Cited

U.S. PATENT DOCUMENTS

| | | | | | |
|---|---|---|---|---|---|
| 3,946,398 | A * | 3/1976 | Kyser et al. | 347/70 |
| 4,097,872 | A * | 6/1978 | Giordano et al. | 347/21 |
| 4,375,062 | A * | 2/1983 | Sturm | 347/21 |
| 4,458,255 | A | 7/1984 | Giles | |
| 4,701,353 | A * | 10/1987 | Mutsers et al. | 427/213 |
| 4,825,229 | A * | 4/1989 | Matsumoto et al. | 347/83 |
| 5,467,115 | A * | 11/1995 | Childers | 347/47 |
| 5,850,241 | A * | 12/1998 | Silverbrook | 347/54 |
| 7,704,420 | B2 * | 4/2010 | Stevens et al. | 264/12 |
| 2009/0185003 | A1 * | 7/2009 | Bertelsen et al. | 347/47 |

FOREIGN PATENT DOCUMENTS

| | | | | |
|---|---|---|---|---|
| JP | 58-39465 | A | 3/1983 | |
| JP | 59-190859 | A | 10/1984 | |
| JP | 60-23048 | A | 2/1985 | |
| JP | 61-35255 | A | 2/1986 | |
| JP | 2000-62197 | A | 2/2000 | |
| JP | 2011079274 | * | 4/2011 | B41J 2/045 |

* cited by examiner

*Primary Examiner* — Alessandro Amari
*Assistant Examiner* — Michael Konczal
(74) *Attorney, Agent, or Firm* — Cheng-Ju Chiang

(57) ABSTRACT

An inkjet unit and an inkjet device are provided. The inkjet unit includes a liquid compartment that forms a liquid receiving cavity and a jetting nozzle that forms a liquid discharge opening. The liquid receiving cavity is in communication with the liquid discharge opening to allow a liquid contained in the liquid receiving cavity to jet outward through the liquid discharge opening. The inkjet unit further includes a gas supply device. The gas supply device delimits a gas flow channel. The gas flow channel has a gas spray orifice that is arranged to surround an outer wall of the jetting nozzle. Accordingly, the gas supply device can spray a gas through the gas spray orifice toward the circumference of the jetting nozzle to clean the jetting nozzle, keeping liquid from attaching to the circumference of the jetting nozzle and thereby preventing the liquid from blocking the liquid discharge opening.

15 Claims, 3 Drawing Sheets

INKJET UNIT AND INKJET DEVICE

BACKGROUND OF THE INVENTION

1. Field of the Invention

The present invention relates to the field of ink jetting techniques, and in particular to an inkjet unit and an inkjet device.

2. The Related Arts

Nowadays, in the manufacture processes of high-generation TFT-LCD (Thin Film Transistor Liquid Crystal Display), the manufacture of alignment films is a link of vital importance. The manufacture of alignment films is generally done with the technology of inkjet spraying. In other words, an alignment film inkjet machine is applied to spray a liquid for alignment film onto a substrate and the alignment film liquid is spread over the substrate to form a layer of uniform film. Afterwards, manufacturing techniques, such as drying and constant-temperature baking, are taken to complete the manufacture of the alignment film.

Specifically, the conventional techniques of manufacturing alignment films are carried out with an inkjet machine that comprises a number of inkjet units shown in FIG. 1. The inkjet unit shown in FIG. 1 comprises a liquid compartment 10 and a piezoelectric ceramic module 13 attached to an outer wall of the liquid compartment 10. The liquid compartment 10 comprises a receiving cavity 101 and a liquid discharge opening 103 in communication with the receiving cavity 101. The receiving cavity 101 of the liquid compartment 10 functions to receive an alignment film liquid. By applying electricity to the piezoelectric ceramic module 13, the piezoelectric ceramic module 13 is caused to undergo mechanical deformation and thereby compress the alignment film liquid contained in the receiving cavity 101 of the liquid compartment 10 to force the alignment film liquid to jet out of the liquid discharge opening 103.

However, after multiple times of spraying the alignment film liquid with this kind of inkjet unit, the alignment film liquid tends to attach around the liquid discharge opening 103 and block the liquid discharge opening 103, so as to easily cause miss coating and making poor alignment films.

Further, inkjet units that are used in other applications also suffer the same problem.

Thus, it is desired to have an inkjet unit and an inkjet device that incorporates such an inkjet unit to overcome the problem that the liquid discharge opening may get blocked by jetted liquid.

SUMMARY OF THE INVENTION

The technical issue to be addressed by the present invention is to provide an inkjet unit and an inkjet device that overcome the problem that a liquid discharge opening may get blocked by jetted liquid.

To address the above discussed technical issue, the present invention adopts a technical solution, which provides an inkjet unit. The inkjet device comprises a liquid compartment that forms a liquid receiving cavity and a jetting nozzle that forms a liquid discharge opening. The liquid receiving cavity is in communication with the liquid discharge opening to allow a liquid contained in the liquid receiving cavity to jet outward through the liquid discharge opening. The inkjet unit further comprises a gas supply device. The gas supply device is arranged outside the liquid compartment. The gas supply device and the liquid compartment together delimit a gas flow channel. The gas flow channel has a gas spray orifice that is arranged to surround an outer wall of the jetting nozzle. The gas spray orifice comprises a plurality of sub-orifices that is spaced from each other. The plurality of sub-orifices is arranged to surround the outer wall of the jetting nozzle.

Wherein, the gas spray orifice is of an annular form and is set around the outer wall of the jetting nozzle.

Wherein, the plurality of sub-orifices forms spaces therebetween to receive hydrophobe provided therein.

Wherein, the inkjet unit further comprises a piezoelectric ceramic module. The piezoelectric ceramic module comprises a contact wall. The contact wall is positioned against an outer wall of the liquid compartment.

To address the above discussed technical issue, the present invention adopts another technical solution, which provides an inkjet unit. The inkjet unit comprises a liquid compartment that forms a liquid receiving cavity and a jetting nozzle that forms a liquid discharge opening. The liquid receiving cavity is in communication with the liquid discharge opening to allow a liquid contained in the liquid receiving cavity to jet outward through the liquid discharge opening. The inkjet unit further comprises a gas supply device. The gas supply device delimits a gas flow channel. The gas flow channel has a gas spray orifice that is arranged to surround an outer wall of the jetting nozzle.

Wherein, the gas spray orifice is of an annular form and is set around the outer wall of the jetting nozzle.

Wherein, the gas spray orifice comprises a plurality of sub-orifices that is spaced from each other. The plurality of sub-orifices is arranged to surround the outer wall of the jetting nozzle.

Wherein, the plurality of sub-orifices forms spaces therebetween to receive hydrophobe provided therein.

Wherein, the jetting nozzle projects beyond the gas spray orifice.

Wherein, the inkjet unit further comprises a piezoelectric ceramic module. The piezoelectric ceramic module comprises a contact wall. The contact wall being positioned against an outer wall of the liquid compartment.

Wherein, the gas supply device is arranged outside the liquid compartment, and the gas supply device and the liquid compartment together delimit the gas flow channel.

To address the above discussed technical issue, the present invention adopts another technical solution, which provides an inkjet device. The inkjet device comprises a control unit and a plurality of inkjet units. The inkjet device comprises a control unit and a plurality of inkjet units. The inkjet units comprise a liquid compartment that forms a liquid receiving cavity and a jetting nozzle that forms a liquid discharge opening. The liquid receiving cavity is in communication with the liquid discharge opening to allow a liquid contained in the liquid receiving cavity to jet outward through the liquid discharge opening. The inkjet unit further comprises a gas supply device. The gas supply device delimits a gas flow channel. The gas flow channel has a gas spray orifice that is arranged to surround an outer wall of the jetting nozzle. The control unit is connected to the plurality of inkjet units to control operation of the inkjet units.

Wherein, the control unit comprises an inkjet controller. The inkjet controller is connected to each of the inkjet units to the inkjet unit to jet liquid.

Wherein, the control unit comprises a cleaning controller. The cleaning controller is connected to the gas supply device to control the gas supply device to spray a gas for cleaning the jetting nozzle.

Wherein, the gas spray orifice is of an annular form and is set around the outer wall of the jetting nozzle.

Wherein, the gas spray orifice comprises a plurality of sub-orifices that is spaced from each other. The plurality of sub-orifices is arranged to surround the outer wall of the jetting nozzle.

Wherein, the plurality of sub-orifices forms spaces therebetween to receive hydrophobe provided therein.

Wherein, the jetting nozzle projects beyond the gas spray orifice.

Wherein, the inkjet unit further comprises a piezoelectric ceramic module. The piezoelectric ceramic module comprises a contact wall. The contact wall is positioned against an outer wall of the liquid compartment.

Wherein, the gas supply device is arranged outside the liquid compartment. The gas supply device and the liquid compartment together delimit the gas flow channel.

The efficacy of the present invention is that to be distinguished from the state of the art, the present invention provides an inkjet unit and an inkjet device that use a gas supply device to spray a gas through a gas spray orifice toward the circumference of a jetting nozzle in order to clean the jetting nozzle, keeping the liquid from attaching to the circumference of the jetting nozzle and thereby preventing the liquid from blocking the liquid discharge opening.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
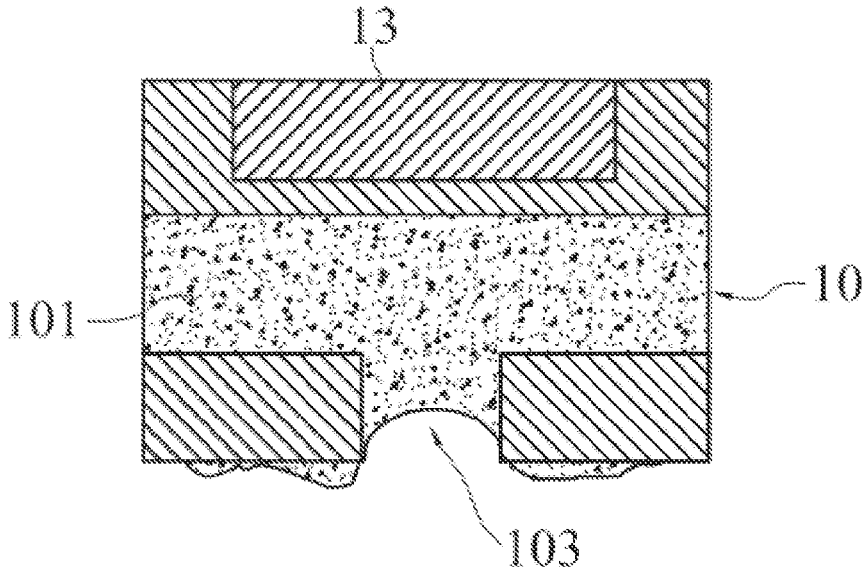
FIG. 1 (Prior Art)
FIG. 1 is a schematic cross-sectional view showing a conventional inkjet unit.
Figure 2:
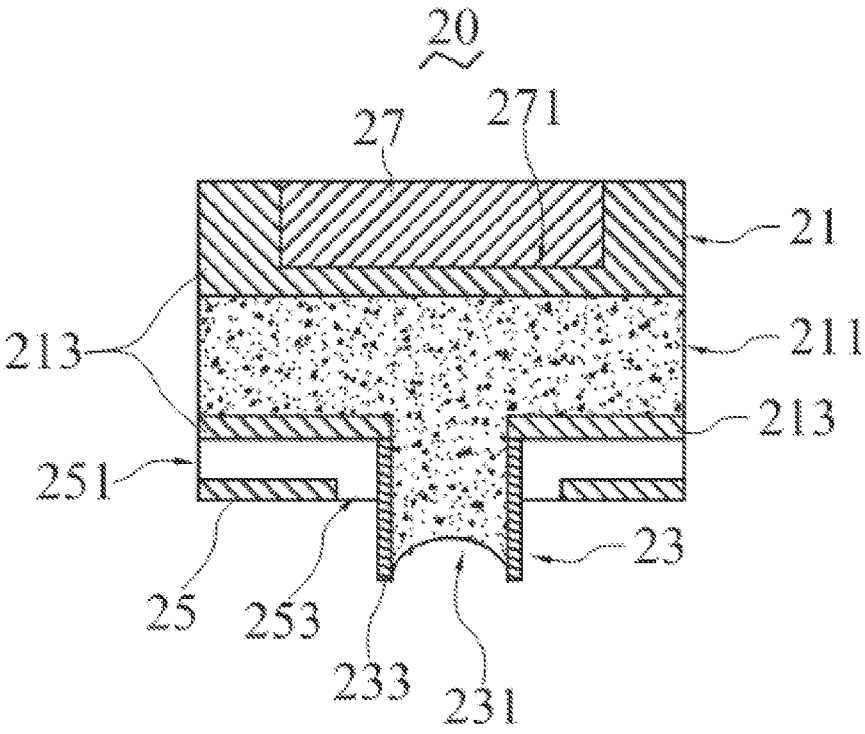
FIG. 2 is a schematic cross-sectional view showing an inkjet unit according to a preferred embodiment of the present invention.

Referring to FIG. 2, FIG. 2 is a schematic cross-sectional view showing an inkjet unit according to a preferred embodiment of the present invention.

The inkjet unit 20 of the present invention comprises a liquid compartment 21, a jetting nozzle 23, a gas supply device 25, and a piezoelectric ceramic module 27.

The liquid compartment 21 comprises an outer wall 213 delimiting a liquid receiving cavity 211. The jetting nozzle 23 is mounted to the outer wall 213 of the liquid compartment 21 and projects outward from the outer wall 213 of the liquid compartment 21. The jetting nozzle 23 has an outer wall 233 delimiting a liquid discharge opening 231. The outer wall 233 of the jetting nozzle 23 and the outer wall 213 of the liquid compartment 21 are fixedly jointed to each other, in which the outer wall 233 of the jetting nozzle 23 can be fixed to the outer wall 213 of the liquid compartment 21 with welding, or can be integrally formed with the outer wall 213 of the liquid compartment 21, no specific limitation being imposed here. The liquid discharge opening 231 of the jetting nozzle 23 is in communication with the liquid receiving cavity 211 to allow a liquid contained in the liquid receiving cavity 211 to jet outward through the liquid discharge opening 231. In an application of the above discussed inkjet unit 20 to the manufacture of alignment films, the liquid contained in the liquid receiving cavity 211 can be a solution of polyamic acid.

The piezoelectric ceramic module 27 comprises a contact wall 271. The contact wall 271 is positioned against the outer wall 213 of the liquid compartment 21. When the inkjet unit 20 is in operation, a control mechanism is applied to control supply and cut-off of electrical power to the piezoelectric ceramic module 27. With electrical power supplied, the piezoelectric ceramic module 27 undergoes mechanical deformation, so that the outer wall 213 of the liquid compartment 21 induces a compression motion, which forces the liquid to jet outward through the liquid discharge opening 231 of the jetting nozzle 23.

The gas supply device 25 is provided on the liquid compartment 21 and defines a gas flow channel 251. The gas flow channel 251 has a gas spray orifice 253 that is arranged to surround the outer wall 233 of the jetting nozzle 23. Further, the gas supply device 25 also comprises a gas source (not shown) that generates a gas. When it is attempted to clean the jetting nozzle 23, the gas supply device 25 sprays the gas out of the gas spray orifice 253 of the gas flow channel 251 to clean off liquid attached around the jetting nozzle 23 in order to keep the liquid from blocking the gas spray orifice 253. Further, the above-discussed inkjet unit 20, when applied to jetting and coating an alignment film liquid, can effectively improve the yield rate of the alignment film.

In the instant embodiment, the gas supply device 25 is arranged outside the outer wall 213 of the liquid compartment 21 and the gas supply device 25 and the outer wall 213 of the liquid compartment 21 together delimit the gas flow channel 251. The gas spray orifice 253 of the gas flow channel 251 is formed to circumferentially surround the outer wall 233 of the jetting nozzle 23. In the instant embodiment, the jetting nozzle 23 projects beyond the gas spray orifice 253 to allow the gas sprayed from the gas spray orifice 253 to sufficiently clean off the liquid attached to the jetting nozzle 23. Certainly, the jetting nozzle 23 can alternatively be arranged flush with the gas spray orifice 253. The gas supplied from the gas supply device 25 can be selected as nitrogen gas or inert gasses.

Figure 3:
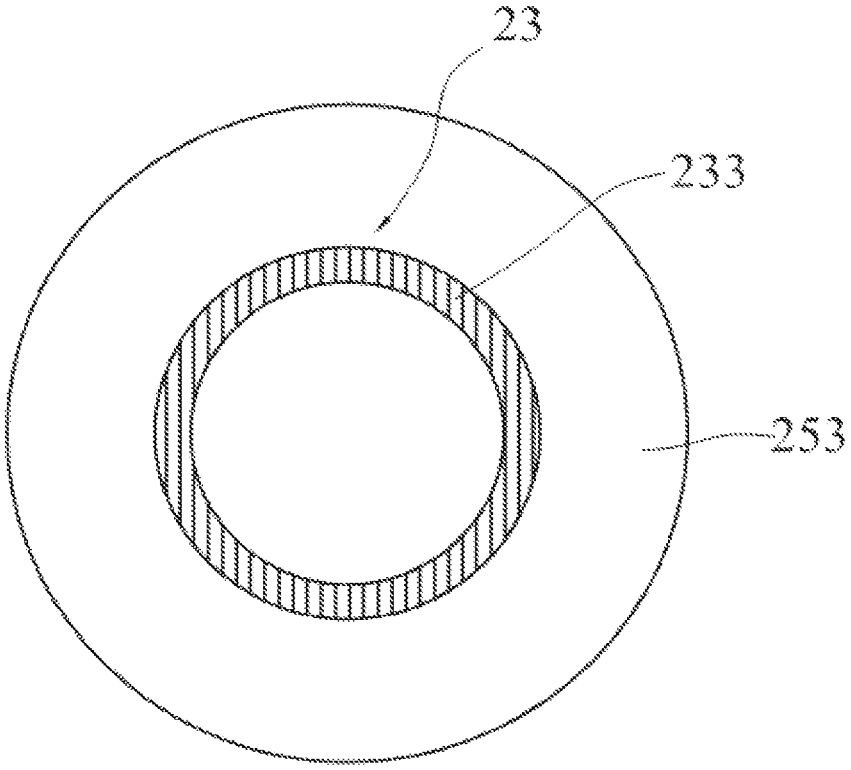
FIG. 3 is a front view showing a gas spray orifice and a liquid discharge opening of the inkjet unit according to a preferred embodiment of the present invention.

Referring to FIG. 3, FIG. 3 is a front view showing the gas spray orifice and the liquid discharge opening of the inkjet unit according to a preferred embodiment of the present invention. In the instant embodiment, the gas spray orifice 253 is of an annular form and is set around the outer wall 233 of the jetting nozzle 23. Under this condition, the gas sprayed from the gas spray orifice 253 may directly act on the circumference of the outer wall 233 of the jetting nozzle 23 to clean off the liquid attached to the jetting nozzle 23.

Figure 4:
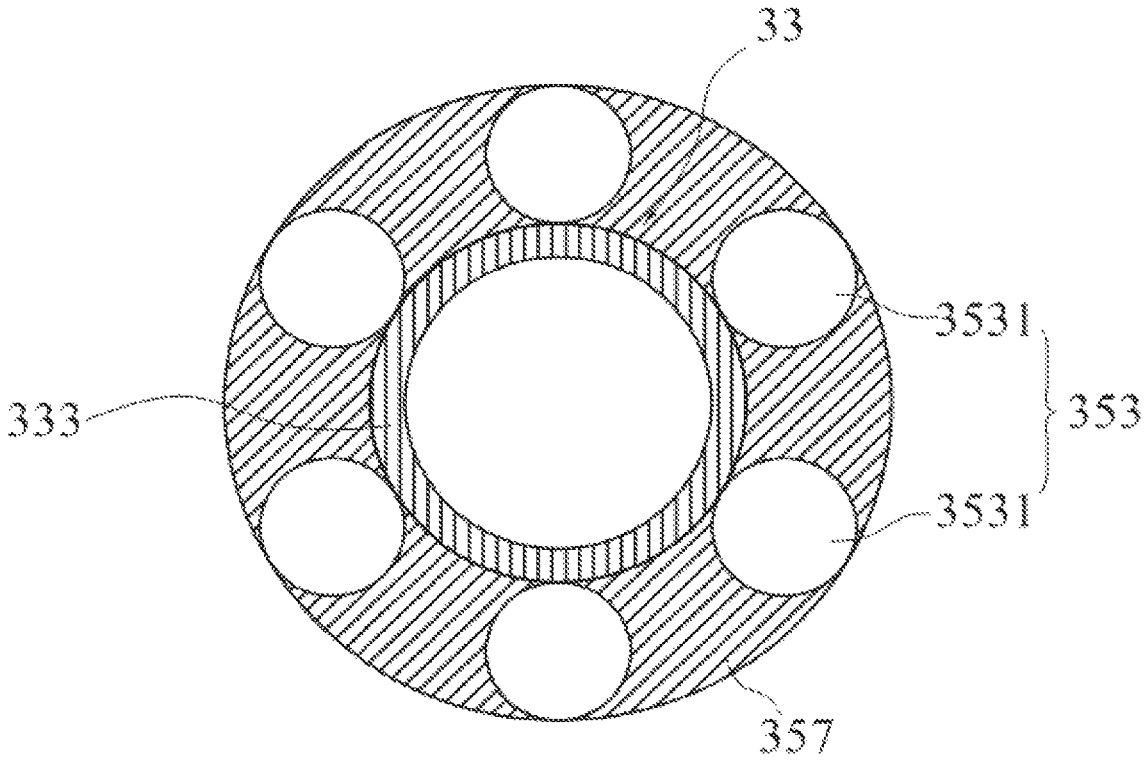
FIG. 4 is a front view showing a gas spray orifice and a liquid discharge opening of the inkjet unit according another preferred embodiment of the present invention.

Referring to FIG. 4, FIG. 4 is a front view showing the gas spray orifice and the liquid discharge opening of the inkjet unit according another preferred embodiment of the present invention. In the instant embodiment, the gas spray orifice 353 comprises a plurality of sub-orifices 3531 that are spaced from each other. The plurality of sub-orifices 3531 is arranged to surround the outer wall 333 of the jetting nozzle 33 and hydrophobe 357 are provided in spaces between the sub-orifices 3531. The hydrophobe 357 are generally made of a hydrophobic material so that the liquid jetted out of the jetting nozzle 33 does not attach to the hydrophobe 357. In the instant embodiment, the sub-orifices 3531 have a shape that is preferably circular. Of course, other shapes can be alternatively used.

Further, the present invention also provides an inkjet device and the inkjet device comprises a plurality of inkjet units described in the above-discussed embodiments. The inkjet device further comprises a control unit connected to the inkjet units.

The control unit comprises an inkjet controller and a cleaning controller. The inkjet controller controls the inkjet units to jet liquid. The cleaning controller is connected to the gas supply device described above, whereby it needs to clean off the liquid attached to the jetting nozzle, the cleaning controller is activated to allow the cleaning controller to control the gas supply device to spray gas for cleaning off the liquid attached to the jetting nozzle.

It is noted that the inkjet unit and the inkjet device using the inkjet unit according to the present invention are not limited to the application and coating of alignment film liquid and may be equally applicable to various inkjet devices, such as inkjet printers.

Embodiments of the present invention have been described, but not to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An inkjet unit, wherein the inkjet unit comprises a liquid compartment that forms a liquid receiving cavity that receives and contains therein a liquid and a jetting nozzle extending in an axial direction from the liquid receiving cavity to a distal end that forms a liquid discharge opening adapted to confront a workpiece, a piezoelectric ceramic module comprising a contact wall that is positioned against an outer wall of the liquid compartment so as to selectively compress the outer wall of the liquid compartment, the liquid receiving cavity being in communication with the liquid discharge opening to allow the liquid contained in the liquid receiving cavity to jet outward through the liquid discharge opening toward the workpiece when the outer wall of the liquid compartment is compressed by the piezoelectric ceramic module, the inkjet unit further comprising a gas supply device, the gas supply device being arranged outside the liquid compartment, the gas supply device and the liquid compartment together delimiting a gas flow channel, the gas flow channel having a gas spray orifice that is arranged to surround an outer wall of the jetting nozzle in such a way that the jetting nozzle projects beyond the gas spray orifice and is exposed to an external atmosphere to allow the liquid jetted through the liquid discharge opening to spray directly to the workpiece without being mixed with a gas that is discharged through the gas spray orifice to the external atmosphere, the gas spray orifice comprising a plurality of sub-orifices that are spaced from each other, the plurality of sub-orifices being arranged to surround the outer wall of the jetting nozzle, whereby the gas discharged through the gas spray orifice is prevented by the outer wall of the jetting nozzle from mixing with the liquid jetted through the liquid discharge opening, the gas being guided by and moving along the outer wall of the jetting nozzle in the axial direction toward the distal end so as to form a circumferential gas curtain around and outside the outer wall of the jetting nozzle and movable relative to the outer wall of the jetting nozzle to prevent a spill of the liquid from moving in a direction transverse to the axial direction and attaching to the outer wall of the jetting nozzle.

2. The inkjet unit as claimed in claim 1, wherein the gas spray orifice is of an annular form and is set around the outer wall of the jetting nozzle.

3. The inkjet unit as claimed in claim 1, wherein the plurality of sub-orifices forms spaces therebetween to receive hydrophobe provided therein.

4. An inkjet unit, wherein the inkjet unit comprises a liquid compartment that forms a liquid receiving cavity that receives and contains therein a liquid and a jetting nozzle extending in an axial direction from the liquid receiving cavity to a distal end that forms a liquid discharge opening adapted to confront a workpiece, a piezoelectric ceramic module comprising a contact wall that is positioned against an outer wall of the liquid compartment so as to selectively compress the outer wall of the liquid compartment, the liquid receiving cavity being in communication with the liquid discharge opening to allow the liquid contained in the liquid receiving cavity to jet outward through the liquid discharge opening toward the workpiece when the outer wall of the liquid compartment is compressed by the piezoelectric ceramic module, the inkjet unit further comprising a gas supply device, the gas supply device delimiting a gas flow channel, the gas flow channel having a gas spray orifice that is arranged to surround an outer wall of the jetting nozzle in such a way that the jetting nozzle projects beyond the gas spray orifice and is exposed to an external atmosphere to allow the liquid jetted through the liquid discharge opening to spray directly to the workpiece without being mixed with a gas that is discharged through the gas spray orifice to the external atmosphere, whereby the gas discharged through the gas spray orifice is prevented by the outer wall of the jetting nozzle from mixing with the liquid jetted through the liquid discharge opening, the gas being guided by and moving along the outer wall of the jetting nozzle in the axial direction toward the distal end so as to form a circumferential gas curtain around and outside the outer wall of the jetting nozzle and movable relative to the outer wall of the jetting nozzle to prevent a spill of the liquid from moving in a direction transverse to the axial direction and attaching to the outer wall of the jetting nozzle.

5. The inkjet unit as claimed in claim 4, wherein the gas spray orifice is of an annular form and is set around the outer wall of the jetting nozzle.

6. The inkjet unit as claimed in claim 4, wherein the gas spray orifice comprises a plurality of sub-orifices that are spaced from each other, the plurality of sub-orifices being arranged to surround the outer wall of the jetting nozzle.

7. The inkjet unit as claimed in claim 6, wherein the plurality of sub-orifices forms spaces therebetween to receive hydrophobe provided therein.

8. The inkjet unit as claimed in claim 4, wherein the gas supply device is arranged outside the liquid compartment, the gas supply device and the liquid compartment together delimiting the gas flow channel.

9. An inkjet device, wherein the inkjet device comprises a control unit and a plurality of inkjet units, the inkjet units comprising a liquid compartment that forms a liquid receiving cavity that receives and contains therein a liquid and a jetting nozzle extending in an axial direction from the liquid receiving cavity to a distal end that forms a liquid discharge opening adapted to confront a workpiece, a piezoelectric ceramic module comprising a contact wall that is positioned against an outer wall of the liquid compartment so as to selectively compress the outer wall of the liquid compartment, the liquid receiving cavity being in communication with the liquid discharge opening to allow the liquid contained in the liquid receiving cavity to jet outward through the liquid discharge opening toward the workpiece when the outer wall of the liquid compartment is compressed by the piezoelectric ceramic module, the inkjet unit further comprising a gas supply device, the gas supply device delimiting a gas flow channel, the gas flow channel having a gas spray orifice that is arranged to surround an outer wall of the jetting nozzle in such a way that the jetting nozzle projects beyond the gas spray orifice and is exposed to an external atmosphere to allow the liquid jetted through the liquid discharge opening to spray directly to the workpiece without being mixed with a gas that is discharged through the gas spray orifice to the external atmosphere, whereby the gas discharged through the gas spray orifice is prevented by the outer wall of the jetting nozzle from mixing with the liquid jetted through the liquid discharge opening, the gas being guided by and moving along the outer wall of the jetting nozzle in the axial direction toward the distal end so as to form a circumferential gas curtain around and outside the outer wall of the jetting nozzle and movable relative to the outer wall of the jetting nozzle to prevent a spill of the liquid in a direction transverse to the axial direction and attached to the outer wall of the jetting nozzle, the control unit being connected to the plurality of inkjet units to control operation of the inkjet units.

10. The inkjet device as claimed in claim 9, wherein the control unit comprises an inkjet controller, the inkjet controller being connected to each of the inkjet units to control the inkjet unit to jet liquid.

11. The inkjet device as claimed in claim 10, wherein the control unit comprises a cleaning controller, the cleaning controller being connected to the gas supply device to control the gas supply device to spray a gas for cleaning the jetting nozzle.

12. The inkjet device as claimed in claim 9, wherein the gas spray orifice is of an annular form and is set around the outer wall of the jetting nozzle.

13. The inkjet device as claimed in claim 9, wherein the gas spray orifice comprises a plurality of sub-orifices that are spaced from each other, the plurality of sub-orifices being arranged to surround the outer wall of the jetting nozzle.

14. The inkjet device as claimed in claim 13, wherein the plurality of sub-orifices forms spaces therebetween to receive hydrophobe provided therein.

15. The inkjet device as claimed in claim 9, wherein the gas supply device is arranged outside the liquid compartment, the gas supply device and the liquid compartment together delimiting the gas flow channel.

* * * * *